US005725986A

United States Patent [19]

Grammatica et al.

[11] Patent Number: 5,725,986

[45] Date of Patent: Mar. 10, 1998

[54] IMAGING PROCESS USING A DIARYLAMINE AND TRITOLYLAMINE IN A CHARGE TRANSPORT LAYER

[75] Inventors: Steven J. Grammatica, Penfield; Richard L. Schank, Pittsford; Paul J. DeFeo, Sodus Point; Ronald E. Godlove, Bergen; Robert J. Flanagan, Macedon, all of N.Y.

[73] Assignee: Xerox Corporation, Stamford, Conn.

[21] Appl. No.: 622,326

[22] Filed: Mar. 26, 1996

Related U.S. Application Data

[63] Continuation of Ser. No. 176,182, Jan. 3, 1994, abandoned.

[51] Int. Cl.[6] ..... G03G 13/14

[52] U.S. Cl. ..... 430/126; 430/59

[58] Field of Search ..... 430/126, 59

[56] References Cited

U.S. PATENT DOCUMENTS

| | | | |
|---|---|---|---|
| 4,050,935 | 9/1977 | Limburg et al. | 96/1 PC |
| 4,265,990 | 5/1981 | Stolka et al. | 430/59 |
| 4,281,054 | 7/1981 | Horgan et al. | 430/59 |
| 4,297,425 | 10/1981 | Pai et al. | 430/58 |
| 4,457,994 | 7/1984 | Pai et al. | 430/59 |
| 4,585,322 | 4/1986 | Reale | 355/3 |
| 4,599,286 | 7/1986 | Limburg et al. | 430/59 |
| 4,780,385 | 10/1988 | Wieloch et al. | 430/58 |
| 5,053,304 | 10/1991 | Mey et al. | 430/59 |
| 5,206,103 | 4/1993 | Stolka et al. | 430/62 |
| 5,257,073 | 10/1993 | Gross et al. | 355/221 |

FOREIGN PATENT DOCUMENTS

| | | |
|---|---|---|
| 0161934 | 11/1985 | European Pat. Off. . |
| 0430284 | 5/1991 | European Pat. Off. . |
| 0449742 | 10/1991 | European Pat. Off. . |
| 62-295057 | 12/1987 | Japan . |

*Primary Examiner*—George F. Lesmes
*Assistant Examiner*—Laura Weiner

[57] ABSTRACT

An imaging process including providing an electrophotographic imaging member including a substrate, a charge generating layer and a charge transport layer including a small molecule hole transporting diarylamine, a small molecule hole transporting tritolyl amine and a film forming binder, depositing a uniform electrostatic charge on the imaging member with a corona generating device to which power is being supplied, the corona generating device comprising at least one bare metal wire adjacent to and spaced from the imaging member, exposing the imaging member with activating radiation in image configuration to form an electrostatic latent image, developing the latent image with marking particles to form a toner image, transfering the toner image to a receiving member, repeating the depositing, exposing, developing, transfering steps, resting the imaging member for at least 15 minutes under the corona generating device while the power to the corona generating device is removed and while the corona generating device is emitting sufficent effluents to render the surface region of the electrophotographic imaging member underlying the corona generating device electrically conductive if the tritolyl amine were replaced with the small molecule hole transporting diarylamine, supplying power to the corona generating device, and repeating the depositing, exposing, developing, transfering steps at least once.

8 Claims, 2 Drawing Sheets

Figure 1:
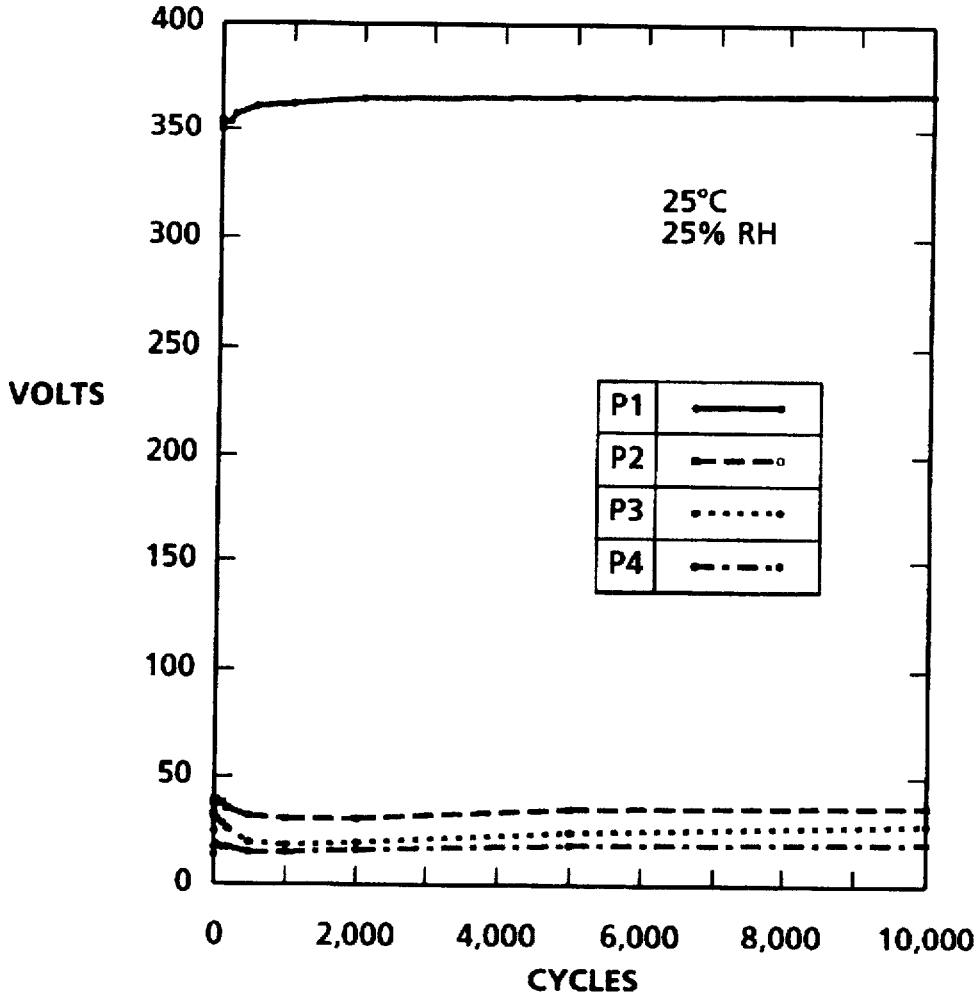

IMAGING PROCESS USING A DIARYLAMINE AND TRITOLYLAMINE IN A CHARGE TRANSPORT LAYER

This is a continuation of application Ser. No. 08/176,182, filed Jan. 3, 1994, now abandoned.

BACKGROUND OF THE INVENTION

This invention relates in general to electrophotographic imaging systems and, more specifically, to an electrophotographic imaging process utilizing layered photoreceptor structures and a corona generating device.

Electrophotographic imaging members, i.e. photoreceptors, typically include a photoconductive layer formed on an electrically conductive substrate. The photoconductive layer is an insulator in the dark so that electric charges are retained on its surface. Upon exposure to light, the charge is dissipated.

A latent image is formed on the photoreceptor by first uniformly depositing an electric charge over the surface of the photoconductive layer by one of any suitable means well known in the art. The photoconductive layer functions as a charge storage capacitor with charge on its free surface and an equal charge of opposite polarity (the counter charge) on the conductive substrate. A light image is then projected onto the photoconductive layer. On those portions of the photoconductive layer that are exposed to light, the electric charge is conducted through the layer reducing the surface charge. The portions of the surface of the photoconductor not exposed to light retain their surface charge. The quantity of electric charge at any particular area of the photoconductive surface is inversely related to the illumination incident thereon, thus forming an electrostatic latent image.

The photodischarge of the photoconductive layer requires that the layer photogenerate conductive charge and transport this charge through the layer thereby neutralizing the charge on the surface. Two types of photoreceptor structures have been employed: multilayer structures wherein separate layers perform the functions of charge generation and charge transport, respectively, and single layer photoconductors which perform both functions. These layers are formed on an electrically conductive substrate and may include an optional charge blocking and an adhesive layer between the conductive layer and the photoconducting layer or layers. Additionally, the substrate may comprise a non-conducting mechanical support with a conductive surface. Other layers for providing special functions such as incoherent reflection of laser light, dot patterns for pictorial imaging or subbing layers to provide chemical sealing and/or a smooth coating surface may be optionally be employed.

One common type of photoreceptor is a multilayered device that comprises a conductive layer, a blocking layer, an optional adhesive layer, charge generating layer, and a charge transport layer. The optional adhesive layer is often employed in photoreceptors on flexible substrates. The charge transport layer can contain an active aromatic diamine molecule, which enables charge transport, dissolved or molecularly dispersed in a film forming binder. This type of charge transport layer is described, for example in U.S. Pat. No. 4,265,990. The disclosures of this patent is incorporated herein in its entirety. Other charge transport molecules disclosed in the prior art include a variety of electron donor, aromatic amines, oxadiazoles, oxazoles, hydrazones and stilbenes for hole transport and electron acceptor molecules for electron transport. Another type of charge transport layer has been developed which utilizes a charge transporting polymer wherein the charge transporting moiety is incorporated in the polymer as a group pendant from the backbone of the polymer backbone or as a moiety in the backbone of the polymer. These types of charge transport polymers include materials such as poly(N-vinylcarbazole), polysilylenes, and others including those described, for example, in U.S. Pat. Nos. 4,618,551, 4,806,443, 4,806,444, 4,818,650, 4,935,487, and 4,956,440. The disclosures of these patents are incorporated herein in their entirety.

One of the design criteria for the selection of the photosensitive pigment for a charge generator layer and the charge transporting molecule for a transport layer is that, when light photons photogenerate holes in the pigment, the holes be efficiently injected into the charge transporting molecule in the transport layer. More specifically, the injection efficiency from the pigment to the transport layer should be high. A second design criterion is that the injected holes be transported across the charge transport layer in a short time; shorter than ,the time duration between the exposure and development stations in an imaging device. The transit time across the transport layer is determined by the charge carrier mobility in the transport layer. The charge carrier mobility is the velocity per unit field and has dimensions of cm2/volt sec. The charge carrier mobility is a function of the structure of the charge transporting molecule, the concentration of the charge transporting molecule in the transport layer and the electrically "inactive" binder polymer in which the charge transport molecule is dispersed. It is believed that the injection efficiency can be maximized by choosing a transport molecule whose ionization potential is lower than that of the pigment. However, low ionization potential molecules may have other deficiencies, one of which is their instability in an atmosphere of corona effluents. A copy quality defect resulting from the chemical interaction of the surface of the transport layer with corona effluents is referred to as "parking deletion" and is described in detail below.

Photoreceptors are cycled many thousands of times in automatic copiers, duplicators and printers. This cycling causes degradation of the imaging properties of photoreceptors, particularly multilayered organic photoconductors which utilize organic film forming polymers and small molecule low ionization donor material in the charge transport layers.

Reprographic machines utilizing multilayered organic photoconductors also employ corona generating devices such as corotrons or scorotrons to charge the photoconductors prior to imagewise exposure. During the operating lifetime of these photoconductors they are subjected to corona effluents which include ozone, various oxides of nitrogen, etc. It is believed that some of these oxides of nitrogen are converted to nitric acid in the presence of water molecules present in the ambient operating atmosphere. The top surface of the photoconductor is exposed to the nitric acid during operation of the machine and photoconductor molecules at the very top surface of the transport layer are converted to what is believed to be the nitrated species of the molecules and these could form an electrically conductive film. However, during operation of the machine, the cleaning subsystem continuously removes (by wear) a region of the top surface thereby preventing accumulation of the conductive species. Unfortunately, such is not the case when the machine is not operating (i.e. in idle mode) between two copy runs. During the idle mode between copy runs, a specific segment of the photoreceptor comes to rest (is parked) beneath a corotron that had been in operation during the copy run. Although the high voltage to the corotron is turned off during the time period when the photoreceptor is parked, some effluents (e.g. nitric acid, etc.) continue to be emitted from the corotron shield, corotron housing, etc. This effluent emission is concentrated in the region of the stationary photoreceptor parked directly underneath the corotron. The effluents render that surface region electrically conductive. When machine operation is resumed for the next copy run, image spreading, loss of resolution and loss of surface voltage occurs. Deletion may also be observed in the loss of fine lines and details in the final print as well as. Thus, the corona induced changes primarily occur at the surface region of the charge transport layer. These changes are manifested in the form of increased conductivity which results in loss of resolution of the final toner images. In the case of severe increases in conductivity, there can be regions of severe deletions in the images. This problem is particularly severe in devices employing arylamine charge transport molecules such as N,N'-diphenyl-N,N'-bis(3-methylphenyl)-(1,1-biphenyl)-4,4'-diamine.

In order to reduce the amount of objectionable corona effluents corona wires, corona shields scorotron grids and the like have been coated with special coatings that absorb the corona effluents. Examples of special coatings for corona generating devices are the dehydrated alkaline film of an alkali silicate described in U.S. Pat. No. 4,585,322 and the boron electroless nickel coating described in U.S. Pat. No. 5,257,073, the disclosures of which are incorporated herein in their entirety. Other known coatings for corona generating devices include electro dag. Also, the inside of corotron housings may be lined with special material such as a carbon fiber cloth for the same purpose.

Thus, although the charge transport molecule meets most other electrophotographic criteria such as being devoid of traps, having high injection efficiency from many pigments, ease in synthesizing, and inexpensive, it encounters serious parking and other deletion problems when an idle mode is interposed between extended cycling runs. Other corrective actions include installation of a fan which circulates air through the charging device after the drum has stopped. Also, overcoatings have been applied to the photoreceptors to protect the underlying charge transport layer. These corrective actions add considerable expense to the charging devices, particularly those for simple, compact low volume copiers and printers using small development module cartridges, thus increasing the costs and complexity significantly. Moreover, the coating of scorotron grids reduces the size of the grid openings thereby reducing the charging effectiveness of the scorotron. Further, because it is difficult to coat scorotron grids uniformly, the size of the scorotron grid openings can vary at different locations on the grid thereby adversely affecting the uniformity of charge deposited on the photoreceptor. In some cases, some grid opening can even be totally closed by the deposited coatings thereby preventing any deposition of charges onto the photoreceptor underlying the closed openings.

INFORMATION DISCLOSURE STATEMENT

U.S. Pat. No. 4,780,385 to Wieloch et al., issued Oct. 25, 1988—An electrophotographic imaging member is disclosed having an imaging surface adapted to receive a negative charge, metal ground plane comprising zirconium, a hole blocking layer, a charge generating layer comprising photoconductive particles dispersed in a film-forming resin binder and a hole transport layer. Beginning, for example, in column 15, it is disclosed that the charge transport layer can contain a film-forming binder and an aromatic amine. Various aromatic amines are described include a triphenyl amine.

U.S. Pat. No. 5,053,304 to Mey et al, issued Oct. 1, 1991—A photoconductive element is disclosed suitable for a multiple electrophotographic copying from a single imaging step. The element preferably incorporates a charge generation layer which comprises a phthalocyanine die or pigment. The copying method involves simultaneous application of corona charge an image exposure to the element followed by uniform radiation of the element. Thereafter a plurality of copies can be made by the same step of toner deposition, toner transfer and toner heat fusion to a receiver. The photoconductor comprises a charge transport layer and at least one aromatic amine hole transport agent and an electrically insulated film-forming organic polymeric binder, a charge generation layer comprising at least one photoconductive phthalocyanine material, an adhesive layer, a solvent holdout layer, an electrically insulating layer, an electrically conductive layer and a support layer. The aromatic amine hole transport agent may be, for example, 1,1-bis(di-4-tolylaminophenyl)cyclohexane or a mixture of tri-4-tolyamine and 1,1-bis(di-4-tolylaminophenyl) cyclohexane.

U.S. Pat. No. 4,265,990 to Stolka et al. issued May 5, 1981—A photosensitive member is disclosed comprising a photoconductive layer and a charge transport layer. The charge transport layer comprises a polycarbonate resin and one or more diamine compounds represented by a certain structural formula.

U.S. Pat. No. 4,297,425 to Pal et al., issued Oct. 27, 1981—A layered photosensitive member is disclosed comprising a generator layer and a transport layer containing a combination of diamine and triphenyl methane molecules dispersed in a polymeric binder.

U.S. Pat. No. 4,050,935 to Limburg et al., issued Sep. 27, 1977—A layered photosensitive member is disclosed comprising a generator layer,of trigonal selenium and a transport layer of bis(4-diethylamino-2-methylphenyl)phenylmethane molecularly dispersed in a polymeric binder.

U.S. Pat. No. 4,457,994 to Pal et al. et al, issued Jul. 3 1984—A layered photosensitive member is disclosed comprising a generator layer and a transport layer containing a diamine type molecule dispersed in a polymeric binder and an overcoat containing triphenyl methane molecules dispersed in a polymeric binder.

U.S. Pat. No. 4,281,054 to Horgan et al., issued Jul. 28, 1981—An imaging member is disclosed comprising a substrate, an injecting contact, or hole injecting electrode overlying the substrate, a charge transport layer comprising an electrically inactive resin containing a dispersed electrically active material, a layer of charge generator material and a layer of insulating organic resin overlying the charge generating material. The charge transport layer can contain triphenylmethane.

U.S. Pat. No. 4,599,286 to Limburg et al., issued Jul. 8, 1982—An electrophotographic imaging member is disclosed comprising a charge generation layer and a charge transport layer, the transport layer comprising an aromatic amine charge transport molecule in a continuous polymeric binder phase and a chemical stabilizer selected from the group consisting of certain nitrone, isobenzofuran, hydroxyaromatic compounds and mixtures thereof. An electrophotographic imaging process using this member is also described.

Although acceptable images may be obtained when chemical triphenyl methanes are incorporated within the bulk of the charge transport layers, as described in U.S. Pat. No. 4,297,425, the photoreceptor can exhibit at least two deficiencies when subjected to extensive cycling. One is that the presence of the triphenyl methane in the bulk of the charge transport layer results in trapping of photoinjected holes from the generator layer into the transport layer giving rise to higher residual potentials. This can cause a condition known as cycle-up in which the residual potential continues to increase with multi-cycle operation. This can give rise to increased densities in the background areas of the final images. A second undesirable effect due to the addition of the triphenyl methane in the bulk of the transport layer is that some of these molecules migrate into the generator layer during the process of the fabrication of the transport layer. The presence of these molecules on the surface of the pigment in the generator layer could result in cyclic instabilities. These two deficiencies limits the concentration of the triphenyl methanes that can be added in the transport layer.

Thus, there is a continuing need for photoreceptors having improved resistance to increased conductivity resulting in loss of resolution of the final toner images or even severe deletions in the images.

SUMMARY OF THE INVENTION

It is, therefore, an object of the present invention to provide an improved electrophotographic imaging member which overcomes the above-noted deficiencies.

It is another object of the present invention to provide an improved electrophotographic imaging member which is stable against copy defects such as print deletion.

It is yet another object of the present invention to provide an improved electrophotographic imaging member having greater stability against corona induced chemical changes.

It is another object of the present invention to provide an improved electrophotographic imaging member which avoids residual charge build up.

The foregoing objects and others are accomplished in accordance with this invention by an imaging process comprising providing an electrophotographic imaging member comprising a substrate, a charge generating layer and a charge transport layer comprising a small molecule hole transporting diarylamine, a small molecule hole transporting tritolyl amine and a film forming binder, depositing a uniform electrostatic charge on the imaging member with a corona generating device comprising at least one bare metal wire adjacent to and spaced from the imaging member, exposing the imaging member with activating radiation in image configuration to form an electrostatic latent image, developing the latent image with marking particles to form a toner image, transfering the toner image to a receiving member and repeating the depositing, exposing, developing, transfering steps, resting the imaging member for at least 15 minutes and repeating the depositing, exposing, developing, transfering steps at least once.

Electrophotographic imaging members and electrophotographic methods of imaging with the members are well known in the art. Electrophotographic imaging members may be prepared by any suitable technique. Typically, a flexible or rigid substrate is provided with an electrically conductive surface. A charge generating layer is then applied to the electrically conductive surface. A charge blocking layer may optionally be applied to the electrically conductive surface prior to the application of a charge generating layer. If desired, an adhesive layer may be utilized between the charge blocking layer and the charge generating layer. Usually the charge generation layer is applied onto the blocking layer and a charge transport layer is formed on the charge generation layer. This structure may have the charge generation layer on top of or below the charge transport layer.

The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like.

The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, and more preferably from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum; and the like.

An optional hole blocking layer may be applied to the substrate. Any suitable and conventional blocking layer capable of forming an electronic barrier to holes between the adjacent photoconductive layer and the underlying conductive surface of a substrate may be utilized.

An optional adhesive layer may applied to the hole blocking layer. Any suitable adhesive layer well known in the art may be utilized. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge generator layers may also comprise inorganic pigments of crystalline selenium and its alloys; Group II–VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers utilizing infrared exposure systems. Infrared sensitivity is required for photoreceptors exposed to low cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, magnesium phthalocyanine and metal-free phthalocyanine. The phthalocyanines exist in many crystal forms which have a strong influence on photogeneration.

Any suitable polymeric film forming binder material may be employed as the matrix in the charge generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts and is optimized for the particular device application and coating process to be utilized. For the dip coating process, generally, from about 5 percent by volume to about 90 percent by volume of the photogenerating pigment is dispersed in about 10 percent by volume to about 95 percent by volume of the resinous binder, and preferably from about 40 percent by volume to about 80 percent by volume of the photogenerating pigment is dispersed in about 20 percent by volume to about 60 percent by volume of the resinous binder composition. In one typical embodiment about 80 percent by volume of the photogenerating pigment is dispersed in about 20 percent by volume of the resinous binder composition. The photogenerator layers can also fabricated by vacuum sublimation in which case there is no binder.

Any suitable and conventional technique may be utilized to mix and thereafter apply the photogenerating layer coating mixture. Typical application techniques include spraying, dip coating, roll coating, wire wound rod coating, vacuum sublimation and the like. For some applications, the generator layer may be fabricated in a dot or line pattern. Removing of the solvent of a solvent coated layer may be effected by any suitable conventional technique such as oven drying, infrared radiation drying, air drying and the like.

The charge transport layer comprises a charge transporting diarylamine small molecule and tritolyl amine small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting diarylamine small molecule and tritolyl amine small molecule dispersed in the polymer, the diarylamine and tritolyl amine molecules being dispersed in the polymer on a molecular scale.

Any suitable charge transporting or electrically active diarylamine small molecule may be employed in the charge transport layer of this invention. The expression charge transporting "small molecule" is defined herein as a monomer that allows the free charge photogenerated in the transport layer to be transposed across the transport layer. The diarylamine small molecule has the following structure:

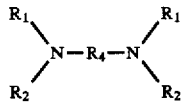

wherein $R_1$ and $R_2$ are an aromatic group selected from the group consisting of a substituted or unsubstituted phenyl group, naphthyl group and polyphenyl group and $R_4$ is selected from the group consisting of a substituted or unsubstituted biphenyl group, biphenyl ether group, alkyl group having from 1 to 18 carbon atoms and cycloaliphatic group having 3 to 12 carbon atoms. The substituents should be free from electron withdrawing groups such as $N_2$ groups, CN groups and the like. Typical diarylamine charge transporting small molecules represented by the formula above for charge transport layers capable of supporting the injection of photogenerated holes of a charge generating layer and transporting the layers through the charge transport layer include, for example, N,N'-diphenyl-N,N'-bis(3-methylphenyl)-(1,1'-biphenyl)-4,4'-diamine, N,N'-bis(alkylphenyl)-[1,1'-biphenyl]-4,4'-diamine, wherein the alkyl is, for example, methyl, ethyl, propyl, n-butyl, etc., N,N'-diphenyl-N,N'-bis(chlorophenyl)-[1,1'-biphenyl]-4,4'-diamine, and the like. As indicated above, suitable electrically active diarylamine small molecule charge transporting compounds are dissolved or molecularly dispersed in electrically inactive polymeric film forming materials. A preferred diarylamine small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine. The concentration of the diarylamine charge transporting molecules in the transport layer can be between 25 and about 90 percent by weight based on the total weight of the charge transporting components in the dried transport layer.

The tritolyl amine, also referred to as p-tritolyl amine or tri(4-methylphenyl) amine, is another essential charge transporting small molecule component in the charge transport layer of the photoreceptor of this invention. The concentration of the charge transporting tritolyl amine small molecule in the transport layer is between about 10 percent and about 99 percent by weight based on the total weight of the charge transporting components in the dried transport layer. When less than about 10 percent by weight of tritolyl amine is present in the transport layer, the beneficial results of resistance to print deletion is less pronounced. When the proportion of tritolyl amine material in the charge transport layer is greater than about 99 percent by weight based on the total weight of the transport layer, the beneficial results of resistance to print deletion is also less pronounced. When less than about 10 percent and greater than about 99 percent by weight of tritolyl amine based on the total weight of the charge transporting components in the dried transport layer is employed in the charge transport layer of drums or belts, loss of surface voltage is also observed. For photoreceptor flat plates, loss of surface voltage is observed at even 10 percent by weight of tritolyl amine based on the total weight of the charge transporting components in the dried transport layer. Thus, a concentration of the charge transporting tritolyl amine molecule in the transport layer is between about 25 percent and about 99 percent by weight based on the total weight of the charge transporting components in the dried transport layer is preferred to ensure avoidance of loss of surface voltage when subjected to image cycling followed by parking under uncoated corona generating devices. The total combined concentration of the diarylamine and tritolyl amine charge transporting molecules should be between about 5 percent and about 50 percent by weight based on the total weight of the dried charge transport layer, the remainder normally being the film forming binder. When the proportion of total small molecule hole transporting molecule in the dried transport layer is less than about 5 percent by weight, the charge transporting properties of the layer is reduced such that the surface voltage in the image exposure area is not reduced and therefor no development will occur. When the proportion of total small molecule charge transport material in the transport layer exceeds about 50 percent by weight based on the total weight of the dried overcoating layer, crystallization may occur resulting in residual cycle-up. Also, the mechanical properties of the film will be degraded resulting in surface cracking and delamination of the layers from each other. Such degradation will significantly reduce the useful life of the device.

Any suitable electrically inactive polymeric film forming resin binder may be utilized in the charge transport layer. Typical inactive resin binders include polycarbonate, polyester, polyarylate, polyacrylate, polyether, polysulfone, and the like. Molecular weights can vary, for example, from about 20,000 to about 150,000. An electrically inert polymeric binder generally used to disperse the electrically active molecule in the charge transport layer is poly (2,2'-methyl-4,4'-isopropylidenediphenylene)carbonate(also referred to as bisphenol-C-polycarbonate) poly (4,4'-isopropylidene-diphenylene)carbonate (also referred to as bisphenol-A-polycarbonate). A preferred electrically inert polymeric binder is poly (4,4'-diphenyl-1,1'-cyclohexane carbonate) (also referred to as bisphenol-Z-polycarbonate).

Any suitable solvent may be employed to apply a solution of the overcoating to the charge generator layer. The solvent should dissolve the diarylamine, the tritolylamine and the film forming binder. The expression "dissolve" as employed herein is defined as capable of forming a solution with which a film can be applied to a surface and dried to form a continuous coating. When the components are "insoluble" on the coating mixture, the coating mixture is not capable of forming a solution so that the solvent and at least one of the other components remain in two separate phases and a continuous coating cannot be formed. Typical solvents include, for example, methylene chloride, toluene, monochloro benzene and the like. When at least one component in the charge transport mixture is not soluble in the solvent utilized, phase separation can occur which would adversely affect the transparency of the overcoating and electrical performance of the final photoreceptor. Satisfactory results may be achieved when the amount of solvent utilized is between about 50 percent by weight and about 95 percent by weight based on the total weight of the transport coating composition. Generally, the optimum amount of solvent utilized depends upon the particular type of coating process utilized to apply the transport coating material.

Any suitable and conventional technique may be utilized to mix and thereafter apply the charge transport layer coating mixture to the charge generating layer. Typical application techniques include spraying, extrusion coating, veneer coating, dip coating, roll coating, slide coating, slot coating, wire wound rod coating, and the like. Drying of the deposited coating may be effected by any suitable conventional technique such as oven drying, infra red radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers is preferably maintained from about 2:1 to 200:1 and in some instances as great as 400:1. In other words, the charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

Other suitable layers may also be used such as a conventional electrically conductive ground strip along one edge of the belt or drum in contact with the conductive surface of the substrate to facilitate connection of the electrically conductive layer of the photoreceptor to ground or to an electrical bias. Ground strips are well known and usually comprise conductive particles dispersed in a film forming binder.

In some cases an anti-curl back coating may be applied to the side opposite the photoreceptor to provide flatness and/or abrasion resistance for belt or web type photoreceptors. These anti-curl back coating layers are well known in the art and may comprise thermoplastic organic polymers or inorganic polymers that are electrically insulating or slightly semiconducting.

Surprisingly, the photoreceptor of this invention can be used with uncoated corona generating devices in copy runs (power constantly supplied to corona generating devices) followed by rest periods (no power supplied to corona generating devices) and still produce high quality copies in subsequent runs. Thus, during the idle mode between copy runs when no power is supplied to the corona generating device, the segment of the photoreceptor coming to rest ("parked") beneath a corotron that had been in operation (power supplied) during the preceding copy run does not present image deletion problems when machine operation is resumed for the next copy run. In other words, image spreading and loss of resolution are avoided when machine operation is resumed for the next copy run when power is resupplied to the corona generating device. Bare uncoated corona or scorotron wires, uncoated corotron and scorotron shields and uncoated scorotron grids may be utilized in electrophotographic imaging processes with the photoreceptor of this invention. Uncoated corona or scorotron wires, corotron and scorotron shields and scorotron grids may comprise any suitable bare uncoated metal such as tungsten, stainless steel, platinum, and the like. The corona generating device wire may be a single wire or a plurality of wires. As is well known in the art, corona or scorotron wires, corotron and scorotron shields and scorotron grids are positioned parallel to and spaced from the imaging surface of photoreceptors. Examples of common relative positions of these elements are illustrated, for example, in U.S. Pat. No. 4,585,322 and U.S. Pat. No. 5,257,073, the disclosures of which are incorporated herein in their entirety. In other words, the process of this invention involves the use of uncoated corona generating devices emitting effluents onto the photoreceptor of this invention during an imaging run (power constantly supplied to corona generating devices) followed by emission of effluents by the uncoated corona generating devices onto the photoreceptor parked thereunder during a rest period (no power supplied to corona generating devices) of at least about 15 minutes and resumption of imaging cycles (power resupplied to corona generating devices) to form high quality copies free of image spreading, loss of resolution or deletion problems. Since the uncoated corona generating devices continue to emit effluents even though the high voltage to the corotron is turned off during the time period when the photoreceptor is parked, the achievement of high quality copies upon resumption of imaging with photoreceptor containing the combination of a diaryl amine and tritolyl amine in the charge transport layer is totally unexpected. Thus, corona generating devices unfettered with coatings, cloths or other ancillary contrivances can be successfully utilized in the extended imaging process of this invention. Thus, as a point of reference, where after a period of image cycling, an imaging member having only small molecule hole transporting diarylamine and a binder (free of tritolyl amine) in the charge transport layer is rested for at least 15 minutes under a corona generating device while power to the corona generating device is removed and while the corona generating device is emitting sufficent effluents to render the surface region of the electrophotographic imaging member underlying the corona generating device electrically conductive, an identical imaging member, altered to substitute small molecule hole transporting tritolyl amine for between about 10 percent and about 99 percent by weight of the small molecule hole transporting diarylamine, will form high quality copies free of image spreading, loss of resolution or deletion problems under the same conditions.

The imaging member and uncoated corona generating device combination of this process invention is used in any suitable, well known electrophotographic imaging process involving depositing a uniform electrostatic charge on the imaging member with the corona generating device comprising at least one bare metal wire, exposing the imaging member with activating radiation in image configuration to form an electrostatic latent image, developing the latent image with marking particles to form a toner image, transfering the toner image to a receiving member and repeating the depositing, exposing, developing, transfering steps, resting the imaging member for at least 15 minutes while the corona generating device is emitting effluents would normally render the surface region of a conventional electrophotographic imaging member underlying the corona generating device electrically conductive and repeating the depositing, exposing, developing, transfering steps at least once.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

TEST PROCEDURES UTILIZED IN FOLLOWING EXAMPLES

Scanner Characterization

Each photoconductor device to be evaluated is mounted on a cylindrical aluminum drum substrate which is rotated on a shaft. The device is charged by a corotron mounted along the periphery of the drum. The surface potential is measured as a function of time by capacitively coupled voltage probes placed at different locations around the shaft. The probes are calibrated by applying known potentials to the drum substrate. The devices on the drums are exposed by a light source located at a position near the drum downstream from the corotron. As the drum is rotated, the initial (pre-exposure) charging potential is measured by voltage probe 1 (P1). Further rotation leads to the exposure station, where the photoconductor device is exposed to monochromatic radiation of known intensity. The device is erased by light source located at a position upstream of charging. The measurements made include charging of the photoconductor device in a constant current or voltage mode. The device is charged to a negative or positive polarity corona. As the drum is rotated, the initial charging potential is measured by voltage probe 1. Further rotation leads to the exposure station, where the photoconductor device is exposed to monochromatic radiation of known intensity. The surface potential after exposure is measured by voltage probes 2 (P2) and 3 (P3). The device is finally exposed to an erase lamp of appropriate intensity and any residual potential is measured by voltage probe 4 (P4). The process is repeated with the identical conditions as described above and the voltages measured at the respective probes recorded for each cycle. A graph can then be constructed describing the cyclic properties of the device. Photoreceptor devices that have little or no change in the voltages measured over the number of cycles are thought to be stable.

Parking Deletion Test

A negative corotron is operated (with high voltage connected to the corotron wire) opposite a grounded electrode for several hours. The high voltage is turned off, and the corotron is placed (or parked) for thirty minutes to 2 hours on a segment of the photoconductor device being tested. Only a short middle segment of the device is thus exposed to the corotron effluents. Unexposed regions on either side of the exposed regions are used as controls. The photoconductor device is then tested in a scanner for positive charging properties for systems employing donor type molecules. In copiers and printers, these systems are operated with negative polarity corotron in the latent image formation step. An electrically conductive surface region (excess hole concentration) appears as a loss of positive charge acceptance or increased dark decay in the exposed regions (compared to the unexposed control areas on either side of the short middle segment) Since the electrically conductive region is located on the surface of the device, a negative charge acceptance scan is not affected by the corotron effluent exposure (negative charges do not move through a charge transport layer made up of donor molecules). However, the excess carriers on the surface cause surface conductivity resulting in loss of image resolution and, in severe cases, causes deletion.

EXAMPLE I

A photoreceptor was prepared by forming coatings using conventional techniques on an aluminum drum, having a length of 33.8 cm and a diameter of 40 millimeters. The first deposited coating was an alcohol soluble nylon barrier layer formed from a mixture of methanol and butanol having a thickness of 1.5 micrometers. The next coating was a charge generator layer containing 60 percent by weight of a mixture of 25 percent titanyl phthalocyanine, 75 percent chloroindium phthalocyanine particles dispersed in polyvinyl butyral resin (B79, available from Monsanto Chemical) having a thickness of 0.25 micrometer. The next layer was a charge transport layer formed with a solution containing 100 grams of N,N'-diphenyl-N,N'-bis(3-methyl-phenyl)-(1,1'biphenyl)-4,4'-diamine and 150 grams of poly (4,4'-diphenyl-1,1'-cyclohexane carbonate) polycarbonate resin, (IUPILON Z-200, available from Mitsubishi Gas Chemical Company, Inc.) dissolved in 750 grams of monochloro benzene solvent using dip coating. The N,N'-diphenyl-N,N'-bis(3-methyl-phenyl)-(1,1'biphenyl)-4,4'-diamine is an electrically active aromatic diamine charge transport small molecule whereas the polycarbonate resin is an electrically inactive film forming binder. The coated device was dried at 115° C. for 45 minutes in a forced air oven to form a 20 micrometer thick charge transport layer.

This photoreceptor was tested at 31° C. (80° F.) and 80 percent humidity in a xerographic copier employing the conventional electrophotographic imaging cycles of depositing a uniform electrostatic charge on the imaging member with the corona generating device, exposing the imaging member with activating radiation in image configuration to form an electrostatic latent image, developing the latent image with marking particles to form a toner image, transfering the toner image to a receiving member and repeating the depositing, exposing, developing, transfering steps. The corona generating device for depositing the uniform charge consisted of one bare metal corona wire spaced 5 millimeters from the surface of the photoreceptor, an uncoated metal backing shield and an uncoated metal grid positioned between the corona wire and photoreceptor surface. The backing shield had a "U" shaped cross section, the walls of which were spaced 5 millimeters form the corona wire. the metal grid was spaced 5 millimeters from the corona wire and spaced 7 millimeters from the photoreceptor surface. The voltage applied to the corona wire during charging was 2.2 kilovolts having a negative polarity and the voltage applied to the metal grid during charging was 350 volts having a negative polarity. The photoreceptor drum was rotated at 30 revolutions per minute. The photoreceptor was subjected to a series of 1,000 complete xerographic imaging cycles followed by a rest period of from 15 minutes and up to 16 hours during which the photoreceptor was stationary and no voltage was applied to the corona wire and grid. Following each rest period, complete electrophotographic image cycling was resumed with charging voltage again being applied to the corona wire and grid. Examination of the copies produced upon resumption of image cycling showed image deletion occurred in the region of the photoreceptor surface above which the charging device was positioned during the rest period.

EXAMPLE II

The procedures described in Example I were repeated with identical materials and conditions except that the charge transport layer was formed with a solution containing 75 grams of tritolyl amine, 25 grams of N,N'-diphenyl-N,N'-bis(3-methyl-phenyl)-(1,1'biphenyl)-4,4'-diamine and 150 grams of poly (4,4'-diphenyl-1,1'-cyclohexane carbonate) polycarbonate resin [poly(PCZ200], dissolved in 750 grams of monochloro benzene solvent. The photoreceptor was subjected to a series of 1,000 complete xerographic imaging cycles followed by a rest period of from 15 minutes and up to 16 hours during which the photoreceptor was stationary and no voltage was applied to the corona wire and grid. Examination of the copies produced upon resumption of image cycling showed that no image deletion occurred in the region of the photoreceptor surface above which the charging device was positioned during the rest period.

The photoreceptor was mounted into the scanner described previously and subjected to a test to determine its cyclic characteristics. FIG. 1 shows the conditions and results of the test. The figure shows no cyclic instabilities such as cycle up, over the 10 thousand xerographic cycles.

EXAMPLE III

Figure 2A:
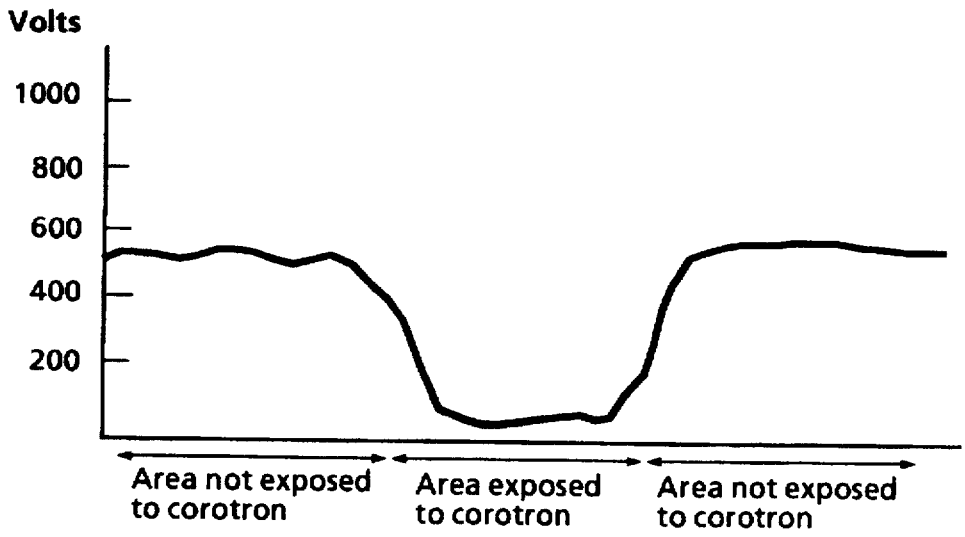

A 60 cm×200 cm (8 inch) polyethylene terephthalate web coated with a vacuum deposited coating of titanium, a 0.2 micrometer thick polyester adhesive layer, a 0.5 micrometer thick charge generating layer containing 50 percent by weight vanadyl phthalocyanine and 50 percent by weight polyester (PE100 available, from E. I. dupont de Nemours & Co.), was coated with a solution of 45 grams of N,N'-diphenyl-N,N'-bis(3-methyl-phenyl)-(1,1'biphenyl)-4,4'-diamine and 55 grams of poly (4,4'-diphenyl-1,1'-cyclohexane carbonate)polycarbonate resin, dissolved in 300 grams of methylene chloride solvent. The applied coating was dried under cover in a hood (fan off), for about 45 minutes at 100° C. The dried coating thickness was 14–17 micrometers. This sample was tested using the Parking Deletion Test described above. The negative corotron employed was a bare, uncoated tungsten metal wire. The negative corotron was operated, with high voltage connected to the corotron wire opposite a grounded electrode for a period of 2 hours. The high voltage was turned off, and the corotron placed (parked) for 30 minutes on a segment of the photoconductive coating of Example III. Only the middle segment of the sample was exposed to the corotron effluents. Unexposed regions on either side of the exposed region was used as controls. The photoconductive device was then tested using a scanner for positive charging properties (these photoconductive devices are operated with a negative polarity corotron in the latent image formation step in copiers and printers.) Examination of the charging profile from probe 1, for this sample showed that the middle area of the sample exposed to the corotron effluent had significantly lower charging compared to the non exposed areas on each side of the middle area. An electrically conductive surface region (excess hole concentration) appears as a loss of positive charge acceptance or increased dark decay in the exposed middle segment, compared to the unexposed control areas on either side. Since the electrically conductive region is located on the surface of the device, a negative charge acceptance scan is not affected by the corotron effluent exposure (negative charges do not move through a charge transport layer made up of donor molecules). However the excess carriers on the surface cause surface conductivity resulting in loss of image resolution and, in severe cases, cause deletions. FIG. 2*a* shows the charging profile for the sample. The areas of the sample exposed to the corotron effluent show significantly lower charging compared to the non exposed areas. Since these types of charge transport molecules only transport holes, it must be concluded that free charge carriers created by the corotron effluent at the CTL surface are the cause of the low charge acceptance.

EXAMPLE IV

Figure 2B:
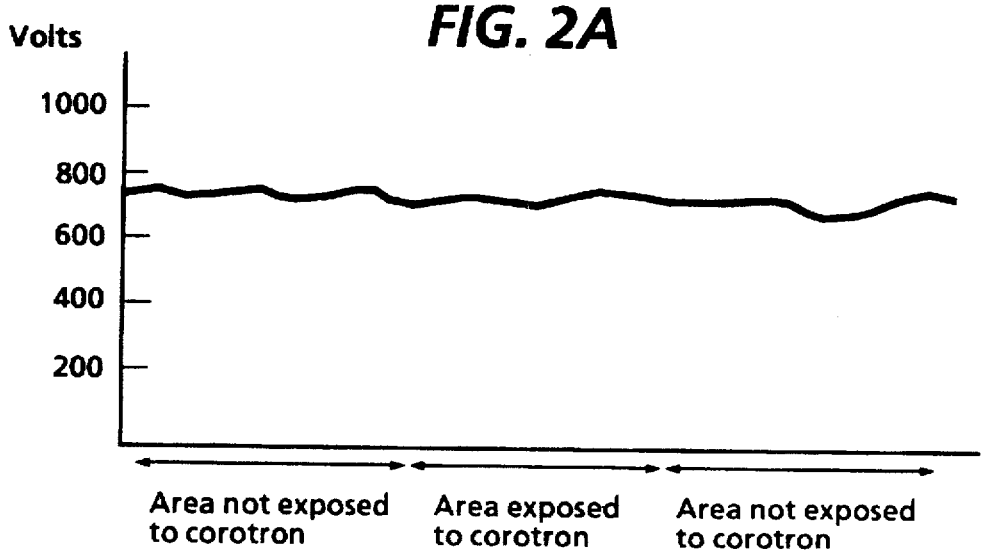

The procedures described in Example III were repeated with the same materials and conditions except that the charge generating layer was coated with a solution of 33.75 grams of tritolyl amine, 11.25 grams of N,N'-diphenyl-N,N'-bis(3-methyl-phenyl)-(1,1'biphenyl)-4,4'-diamine and 55 grams of polycarbonate resin [poly(4,4'-diphenyl-1,1'-cyclohexane carbonate], dissolved in 300 grams of methylene chloride solvent. The applied coating was dried under cover in a hood (fan off), for about 45 minutes at 100° C. The dried coating thickness was 14–17 micrometers. This sample was tested using the Parking Deletion Test described above. The negative corotron employed was a bare, uncoated tungsten metal wire. Examination of the charging profile, as shown in FIG. 2*b*, for this sample shows that the middle area of the sample exposed to the corotron effluent has the same charging level compared to the non exposed areas on each side of the middle area.

EXAMPLE V

Figure 2C:
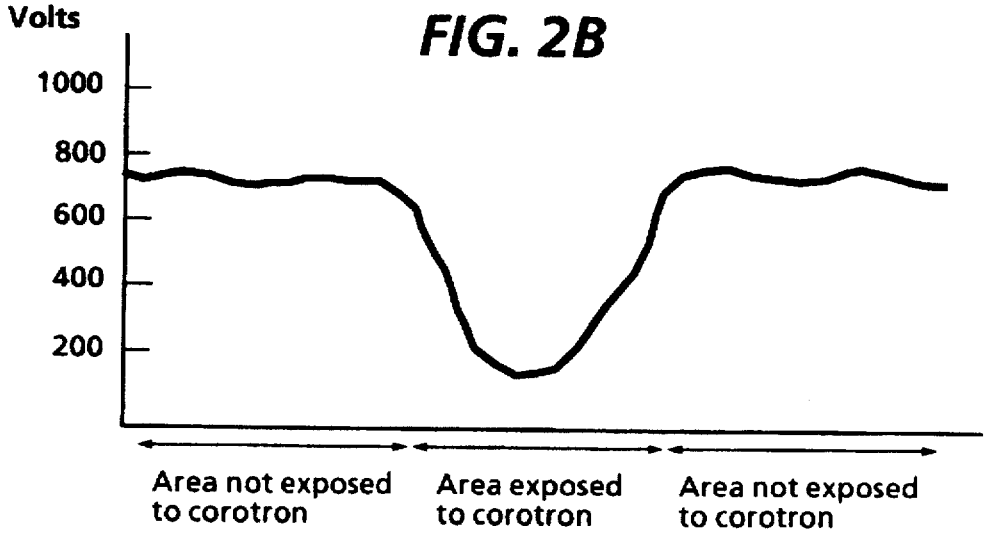

The procedures described in Example IV were repeated with the same materials and conditions except that the charge generating layer was coated with a solution of 4.5 grams of tritolyl amine, 40.5 grams of N,N'-diphenyl-N,N'-bis(3-methyl-phenyl)-(1,1'biphenyl)-4,4'-diamine and 55 gram of polycarbonate resin [poly(4,4'-diphenyl-1,1'-cyclohexane carbonate], dissolved in 300 grams of methylene chloride solvent. The applied coating was dried under cover in a hood (fan off), for about 45 minutes at 100° C. The dried coating thickness was 14–17 micrometers. This sample was tested using the Parking Deletion Test described above. The negative corotron employed was a bare, uncoated tungsten metal wire. Examination of the charging profile, as shown in FIG. 2*c*, for for this sample shows that the middle area of the sample exposed to the corotron effluent has the a lower charging level compared to the non exposed areas on each side of the middle area. But the charging level is higher than the device without the tritolyl amine described in Example 1 and shown in FIG. 2*a*. Thus at tritolyl amine levels of 10 percent of the total charge transporting material, there is a reduction in the loss of surface voltage.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. An imaging process comprising (a) providing an electrophotographic imaging member comprising a substrate, a charge generating layer and a charge transport layer comprising a small molecule hole transporting diarylamine, a small molecule hole transporting tritolyl amine and a film forming binder wherein the concentration of said small molecule hole transporting tritolyl amine molecule in said transport layer is between about 50 percent and about 99 percent by weight based on the total weight of small molecule hole transporting material in said transport layer;

(b) depositing a uniform electrostatic charge on said imaging member with a corona generating device to which power is being supplied, said corona generating device comprising at least one bare metal wire adjacent to and spaced from said imaging member;

(c) exposing said imaging member with activating radiation in image configuration to form an electrostatic latent image;

(d) developing said latent image with marking particles to form a toner image;

(e) transfering said toner image to a receiving member;

(f) repeating the depositing, exposing, developing and transfering steps;

(g) resting said imaging member for at least 15 minutes under said corona generating device while said power to said corona generating device is removed and while said corona generating device is emitting effluents;

(h) supplying power to said corona generating device; and (i) repeating the depositing, exposing, developing and transfering steps at least once.

2. An imaging process according to claim 1 wherein said corona generating device also comprises a bare metal scorotron grid between said imaging member and said bare metal wire.

3. An imaging process according to claim 1 wherein said corona generating device also comprises a bare metal housing adjacent said bare metal wire.

4. An imaging process according to claim 1 wherein the total combined concentration of said diarylamine and said tritolyl amine is between about 5 percent and about 50 percent by weight based on the total weight of said charge transport layer.

5. An imaging process according to claim 1 wherein the concentration of said small molecule hole transporting diarylamine molecule in said transport layer is between about 1 percent and about 90 percent by weight based on the total weight of small molecule hole transporting material in said transport layer.

6. An imaging process according to claim 1 wherein said small molecule hole transporting diarylamine is N,N'-diphenyl-N,N'-bis(3-methylphenyl)-(1,1'-biphenyl)-4,4'-diamine.

7. An imaging process according to claim 1 wherein said film forming binder is a polycarbonate.

8. An imaging process comprising (a) providing an electrophotographic imaging member comprising a substrate, a charge generating layer and a charge transport layer comprising a small molecule hole transporting diarylamine, a small molecule hole transporting tritolyl amine and a film forming binder wherein the concentration of said small molecule hole transporting tritolyl amine molecule in said transport layer is between about 50 percent and about 99 percent by weight based on the total weight of small molecule hole transporting material in said transport layer;

(b) depositing a uniform electrostatic charge on said imaging member with a corona generating device to which power is being supplied, said corona generating device comprising at least one bare metal wire adjacent to and spaced from said imaging member;

(c) exposing said imaging member with activating radiation in image configuration to form an electrostatic latent image;

(d) developing said latent image with marking particles to form a toner image;

(e) transfering said toner image to a receiving member;

(f) repeating the depositing, exposing, developing and transfering steps to form a different toner image on a receiving member;

(g) resting said imaging member for at least 15 minutes under said corona generating device while said power to said corona generating device is removed and while said corona generating device is emitting effluents;

(h) supplying power to said corona generating device; and (i) repeating the depositing, exposing, developing and transfering steps at least once to form a different toner image on a receiving member.

* * * * *